US005997415A

United States Patent [19]

Wood

[11] Patent Number: 5,997,415

[45] Date of Patent: Dec. 7, 1999

[54] GOLF CLUB HEAD

[75] Inventor: Donald C. Wood, Carlsbad, Calif.

[73] Assignee: Zevo Golf Co., Inc., Temecula, Calif.

[21] Appl. No.: 08/798,634

[22] Filed: Feb. 11, 1997

[51] Int. Cl.[6] ..... A63B 53/04

[52] U.S. Cl. ..... 473/346; 473/349

[58] Field of Search ..... 473/324, 345, 473/346, 347, 348, 349, 350

[56] References Cited

U.S. PATENT DOCUMENTS

| | | | |
|---|---|---|---|
| 1,592,463 | 7/1926 | Marker | 473/346 |
| 4,432,549 | 2/1984 | Zebelean | 473/346 |
| 4,465,221 | 8/1984 | Schmidt | 473/346 |
| 4,681,321 | 7/1987 | Chen | 473/346 |
| 4,930,781 | 6/1990 | Allen | 473/346 |
| 5,000,454 | 3/1991 | Soda | 473/346 |
| 5,295,689 | 3/1994 | Lundberg | 473/346 |
| 5,547,427 | 8/1996 | Rigal | 473/346 |

*Primary Examiner*—Sebastiano Passaniti

*Attorney, Agent, or Firm*—Higgs, Fletcher & Mack LLP; Bernard L. Kleinke

[57] ABSTRACT

An improved golf club head incorporating a lattice structure covered by a thin-walled body. The aerodynamically shaped golf club head has a lattice structure formed by an outer ring, curved longitudinal frame elements, and curved latitudinal frame elements. A generally flat shaped ball striking face is formed at one end of the lattice structure. The ball striking face is generally parallelogram shaped and results in a larger and more desirably oriented "sweet spot." The thin-walled body covering the lattice structure defines a cavity, and has a top, a bottom, a toe end, a heel end, and a tail end. The ball striking face extends between the top and the bottom of the thin-walled body at an angle with respect to the vertical. A hosel extends generally upwardly from the heel end of the thin-walled body. Alternative internal energy absorbing and distributing structures, in addition to the lattice structure, are also part of the invention.

22 Claims, 5 Drawing Sheets

GOLF CLUB HEAD

BACKGROUND OF THE INVENTION

1. Field of the Invention

This invention relates generally to golf club heads and more particularly to a novel construction for golf club heads comprising a lattice structure which is covered by a lightweight material to define the body of the golf club head.

2. Description of the Related Art

Golf club heads, specifically those that fall into the "woods" category, were originally manufactured from organic substances, hence the name "woods." The first "metal wood" golf club heads were made in 1870, gaining widespread use in the 1960's. These metal wood golf club heads were very durable and used primarily for practice range purposes. Metal wood heads were further developed and found wider acceptance for everyday use in the late 1970's. The club heads are typically made from a two-piece welded shell construction, and some manufacturers inject the assembled shells with a foam material to tune the noise generated by the collision of the club head with the golf ball and to adjust the head's final weight.

In an effort to make metal woods more playable for the average golfer, the total volume of the metal wood golf club head was increased in 1989. Although the widely practiced two-piece welded shell construction continued to be used, the method to cast the shells changed to a thin wall process. Regardless of the casting method used, the shell of the metal wood continues to be the load bearing structure. Because of the substantial increase in volume realized by this process, the metal wood club head became commonly known as an "oversized" club head and represents the present day state-of-the-art. The materials used in casting the oversized metal wood club head (hereafter "club head") have shifted from stainless steel to titanium, allowing for even larger club head sizes to be realized. The greater strength of titanium when compared to stainless steel allows for thinner club head wall thicknesses, resulting in larger and lighter weight club heads.

Although titanium two-piece welded shells can achieve larger volumes than stainless steel welded shells while maintaining the structural integrity of the load bearing shell, an additional benefit to titanium is that the material allows for a more functional use of discretionary weight. Discretionary weight is basically extra material which is added to a golf club head to adjust the club's hitting characteristics. This discretionary weight is added to the club head after the parameters for the club head have been set. These parameters consist of, but are not limited to, the desired size of the golf club head, wall thickness, structural integrity, and cosmetic considerations.

The performance of the club head can be engineered with different inertial properties resulting in different ball spins, ball speeds, and ball trajectories by the proper positioning of the discretionary weight. Moving the discretionary weight will alter the club head's center of gravity, thereby altering, among other things, the club's moment of inertia.

This ability to "tune" the club is why oversized metal woods perform better than conventional wood heads. Oversized metal woods allow the discretionary weight to be centralized further away from the impact point. Although placing the discretionary weight further from the point of impact translates into shorter distances for which the golf ball is driven after the golf club collides with the golf ball, increased stability of the golf club head is gained. This increase in stability yields better control, resulting in an increase in overall shot performance.

Currently, the size issue of oversized metal wood club head design has reached the point of diminishing returns. Within the current material limitations, the larger the club head, the less discretionary weight is available to tune the club head. Ideally, a new club head structure is needed that makes it possible to increase club head size and make available additional discretionary weight, thereby allowing further increases in golf club performance. The present invention is directed to a golf club head that satisfies this need for an improved structure which realizes the above benefits.

SUMMARY OF THE INVENTION

The present invention is directed to a device which satisfies the need for a golf club head structure that allows the discretionary weight of the golf club head to be increased and positioned so that the distance and direction that a golf ball is driven when struck by the club head is optimized. This advancement in technology is accomplished by eliminating the club head body as the primary load bearing element.

Generally, the golf club head of this invention is a thin-walled body defining a cavity that has a frame structure internal to the cavity. The thin-walled body has a top, a bottom, a curved toe end, a curved heel end, a tail end and a ball striking face which extends between the rounded top and the curved bottom at an angle with respect to the vertical. General golf nomenclature indicates that the toe end is the side of the golf club head furthest away from a golfer that is preparing to strike a golf ball; the heel end is the side of the club nearest the golfer. The ball striking face is generally flat, although it has some curvature, and may have an insert which is positioned substantially central to the ball striking face. The thin-walled body is preferably made from a non-metallic material. It is formed over the frame structure after the frame structure has been formed.

The frame structure is preferably a lattice which has an outer ring having a generally elliptical peripheral shape that is flattened on one side. The flattened side of the outer ring intersects the ball striking face and is integral thereto. Curved longitudinal frame elements are coupled to the ball striking face perimeter and extend from the perimeter to a point on the outer ring which is opposite the ball striking face. Curved latitudinal frame elements which have a generally elliptical peripheral shape are coupled with the outer ring at the latitudinal frame elements outer ends. The latitudinal frame elements also intersect and are integrally connected with the curved longitudinal frame elements. This lattice structure allows for the forces absorbed by the ball striking face when it hits a golf ball to be distributed throughout the frame structure.

The invention affords its users a number of distinct advantages. For example, no golf club head previously existed that is designed using a lattice frame structure that absorbs and distributes the forces encountered by the ball striking face. Also, the thin-walled body of the invention is unique in that it can be non-metallic and is actually formed over the lattice structure. This unique design allows the weight budget of the club head to be distributed to optimize the club head's performance. Current club head design does not allow for further increases in club head size while maintaining a suitable weight budget because weight is expended for structural integrity as the head volume grows. But this invention's use of a lattice frame structure covered by a thin-walled cover allows for a substantial increase in the volume of a golf club wood head, a substantial increase in the discretionary weight available to tune the golf club, and an increase in overall shot performance.

BRIEF DESCRIPTION OF THE DRAWING

The objects, advantages and features of the present invention will become better understood with regard to the following detailed description, when read in conjunction with the accompanying drawing, wherein.

DETAILED DESCRIPTION OF THE PREFERRED EMBODIMENTS

Figure 1:
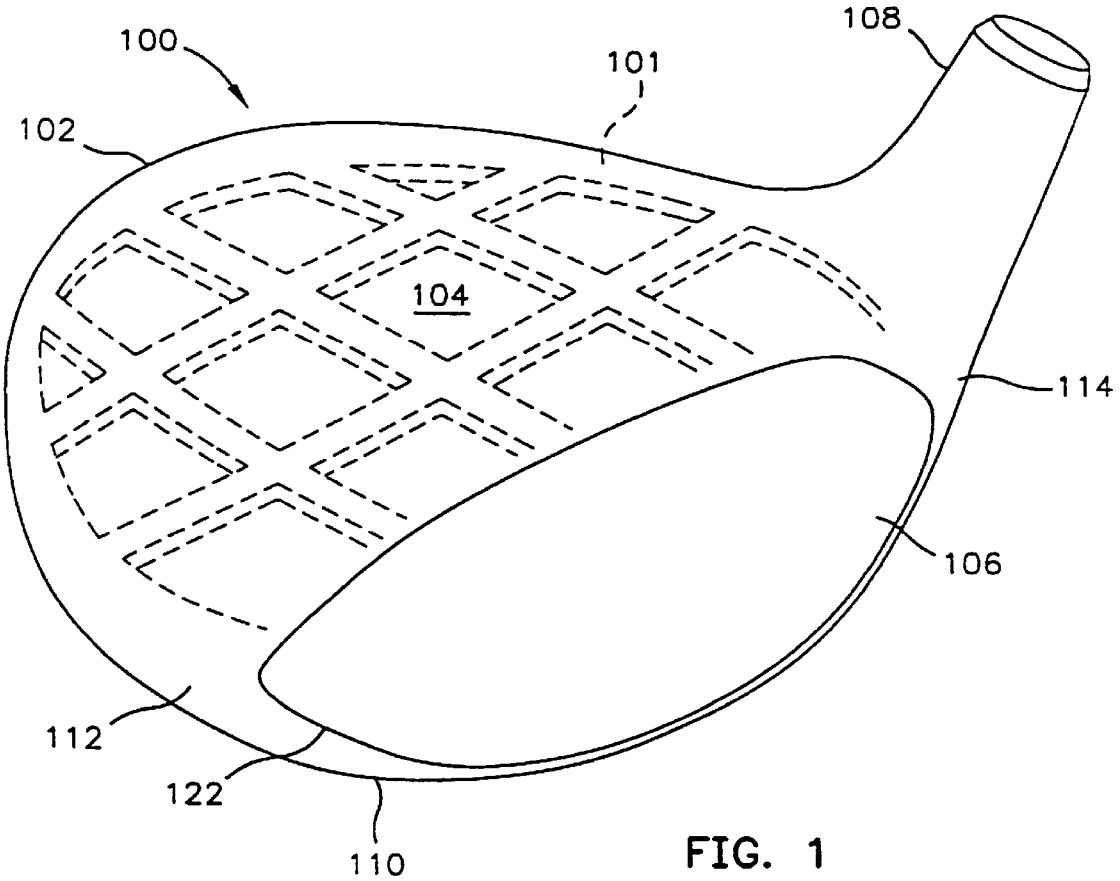
FIG. 1 is a perspective view of the golf club head of the invention.

With reference now to the drawing, and more particularly to FIG. 1 thereof, there is shown a preferred embodiment of a golf club head 100. Lattice structure 101 internal to the club head is shown in broken lines. After forming the lattice structure, thin-walled body or skin 102 is formed over the lattice structure. Club head 100, its shape being defined by skin 102, has a top 104, a bottom 110, a toe end 112, a heel end 114, and a ball striking face 106 having a perimeter 122 extending between top 104 and bottom 110 at an angle with respect to the vertical. In this case, vertical is defined with the club head sitting normally on the ground. Hosel 108 extends generally upwardly from heel end 114 of the club head. It is anticipated that either a fixed hosel (as shown) may be used or that an interchangeable hosel may be substituted, and that generally horizontal broken scoring lines and generally vertical aiming lines may extend over ball striking face 106 to assist the user of the golf club in optimizing the striking of a golf ball.

Figure 2A:
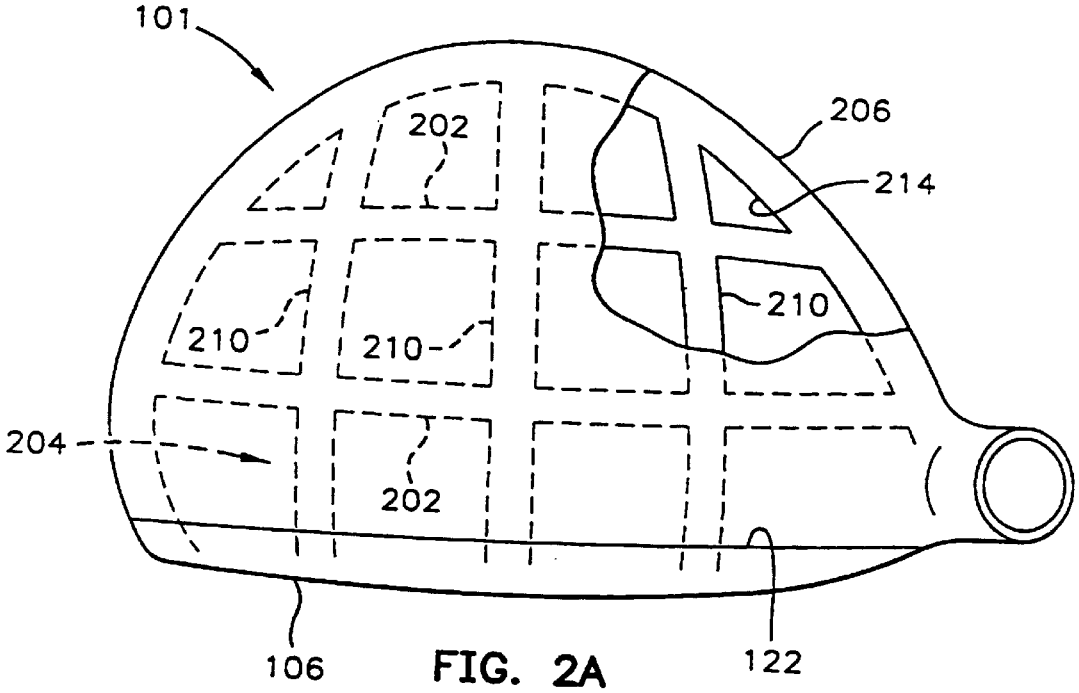
FIG. 2*a* is a top view of the preferred embodiment of the golf club head of FIG. 1 with the lattice structure internal to the body shown by dashed lines.

Lattice structure 101 can be more clearly seen in FIG. 2*a*. In the preferred embodiment, the lattice structure has an elliptical peripheral rib 206, latitudinal frame elements 202 and longitudinal frame elements 204. The longitudinal frame elements comprise upper elements 210 and lower elements (shown in FIG. 2*c*) that extend from ball striking face perimeter 122 and are secured to the peripheral rib 206 opposite to ball striking face 106. Elliptical peripheral rib 206 intersects ball striking face 106 and is secured thereto. Latitudinal frame elements 202 have a generally elliptical peripheral shape and a frame element perimeter 214 (partially shown). The frame element perimeter 214 intersects peripheral rib 206 at various locations and intersects each of the longitudinal frame elements. Each intersection is an interconnection of elements. In the preferred embodiment, lattice structure 101, through peripheral rib 206, latitudinal frame elements 202, the longitudinal frame elements and ball striking face 106, distributes the forces encountered by the club head when a golf ball is struck by ball striking face 106. Although lattice structure 101 may be assembled from individual elements, it is preferred that the lattice structure be formed to integrally connect each element. The lattice may be formed by investment, blow, thin wall, centrifugal or other casting methods. Likewise, the lattice may be machined or otherwise constructed as a unitary structure.

Figure 2B:
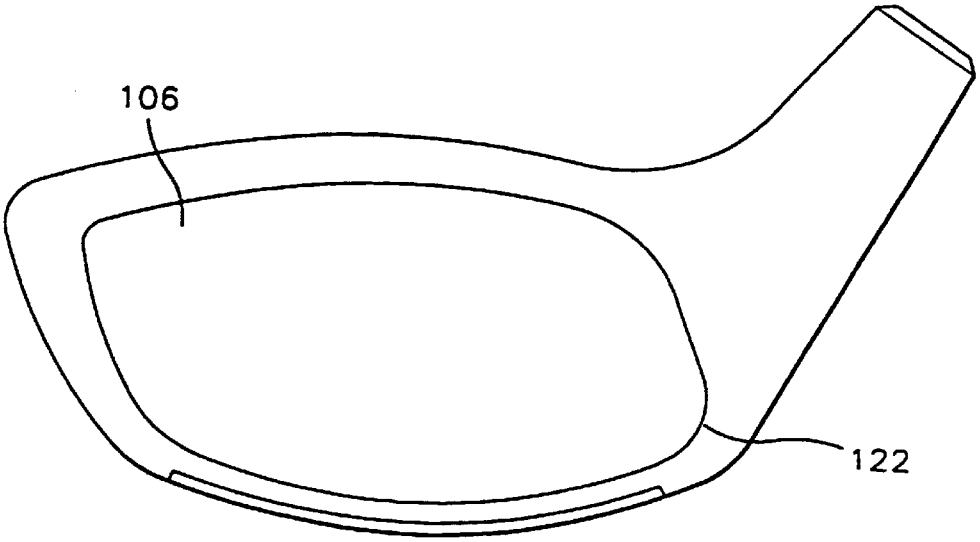
FIG. 2*b* depicts the striking face of the preferred embodiment of the golf club head of FIG. 1.

Ball striking face 106 is best viewed in FIG. 2*b*, which clearly shows perimeter 210. To increase club performance, ball striking face 106 is formed in the general shape of a parallelogram to maximize the area of the ball striking face. Maximizing the face area is desirable because it is widely known in the art that the average golfer commonly strikes a golf ball nearest to the heel end of the striking face which reduces the shot performance. By increasing the face area, this tendency is accommodated.

Figure 2C:
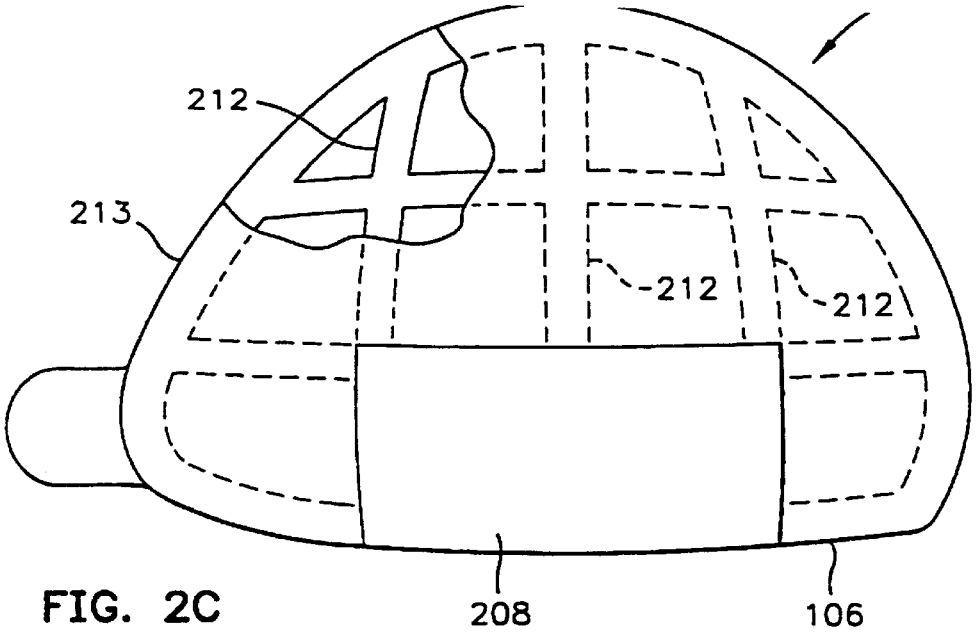
FIG. 2*c* is a bottom view of the preferred embodiment of the golf club head of the invention.
Figure 2D:
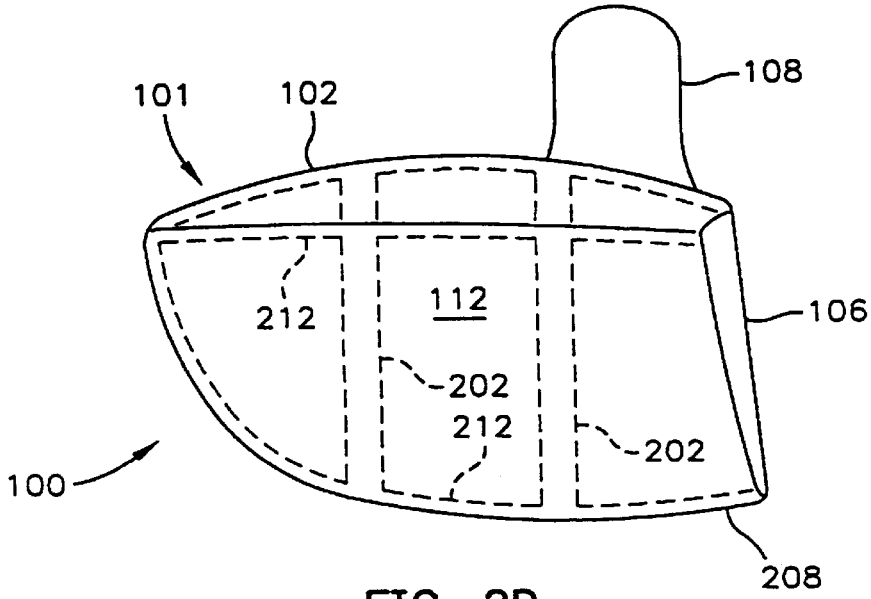
FIG. 2*d* is a toe end view of the preferred embodiment of the golf club head of FIG. 1.

Lattice structure 101 is shown from the bottom in FIG. 2*c*. Bottom plate 208 having a plurality of sides is shown extending rearwardly from ball striking face 106 toward a tail end 213. In the preferred embodiment where lattice structure 101 is formed as an integral frame, bottom plate 208 may be also formed integrally with the lattice structure and the ball striking face. Another view of bottom plate 208 is shown in FIG. 2*d*. The bottom plate interconnects on one side with ball striking face 106 and interconnects on another side with latitudinal frame element 202. Lattice structure 101 is shown in FIG. 2*d* by broken lines internal to thin-walled body 102. Hosel 108 is shown for reference.

Figure 3A:
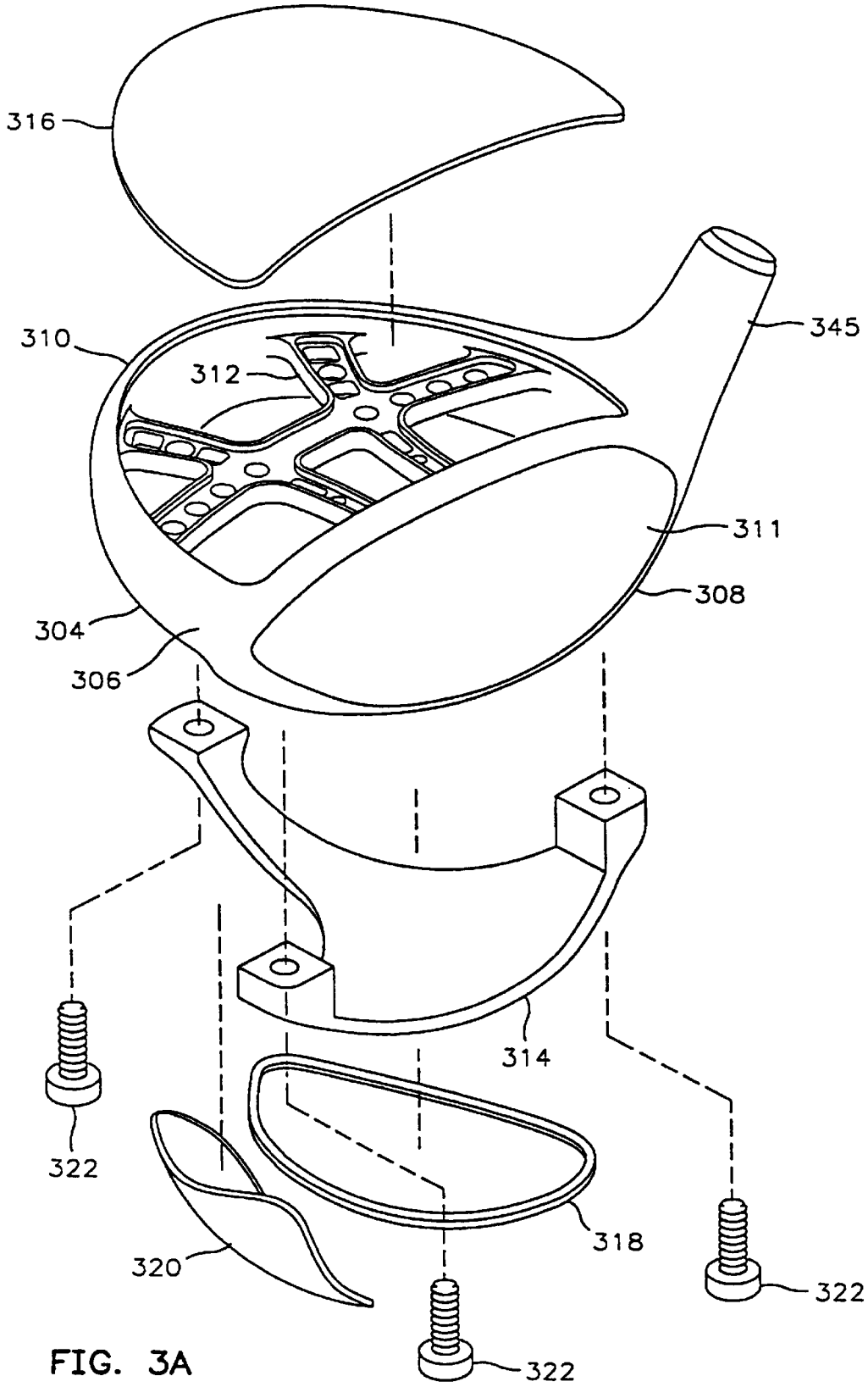
FIG. 3*a* is an exploded view of an alternative embodiment of the golf club head of the invention.

An alternate embodiment of the golf club head of this invention is shown in FIG. 3*a*. A shell body 300 defines a cavity and has a substantially open top 302, a substantially open bottom 304, a toe end 306, a heel end 308, a tail end 310, with a ball striking face 311 extending between top and the bottom of the head at an angle with respect to the vertical. Again, the vertical is defined with the club head sitting normally on the ground. Energy absorbing structure 312 internal to the cavity extends within shell body 300 and acts to distribute forces encountered by ball striking face 311 when a ball is struck, thus allocating needed strength and reinforcement to the head. Each specific arrangement of the various structural legs of structure 312 need not be as shown, but its functions of absorbing and distributing forces is necessary.

It is preferred that shell body 300 and energy absorbing structure 312 shown in FIG. 3*a* be formed as one integral part, for example, by casting or machining. However, separate forming and assembly of the shell body and the structure to form a unitary element is also contemplated. To complete the club head, a top cover 316 is integrated with the substantially open top 302 of the shell body to form a rounded top surface for the club head. A sole plate 314 couples to bottom 304 of the shell body using fasteners such as screws 322, adhesive, bolts, or other similar fasteners. A heel cover 318 and a toe cover 320 are integrated with sole plate 314 on the bottom of the club head. Ideally, the heel cover and the toe cover are constructed from a lightweight transparent thermoplastic. However, any appropriate plastic, fiber, or other similar material will suffice. Heel cover 318 and toe cover 320 are preferably attached to sole plate 314 by adhesive but may be directly attached to bottom 304. Screws, snaps, bolts or any comparable attachment means may be used in place of adhesive. Although two covers are discussed, a heel and a toe cover, any number of covers may be used.

Figure 3B:
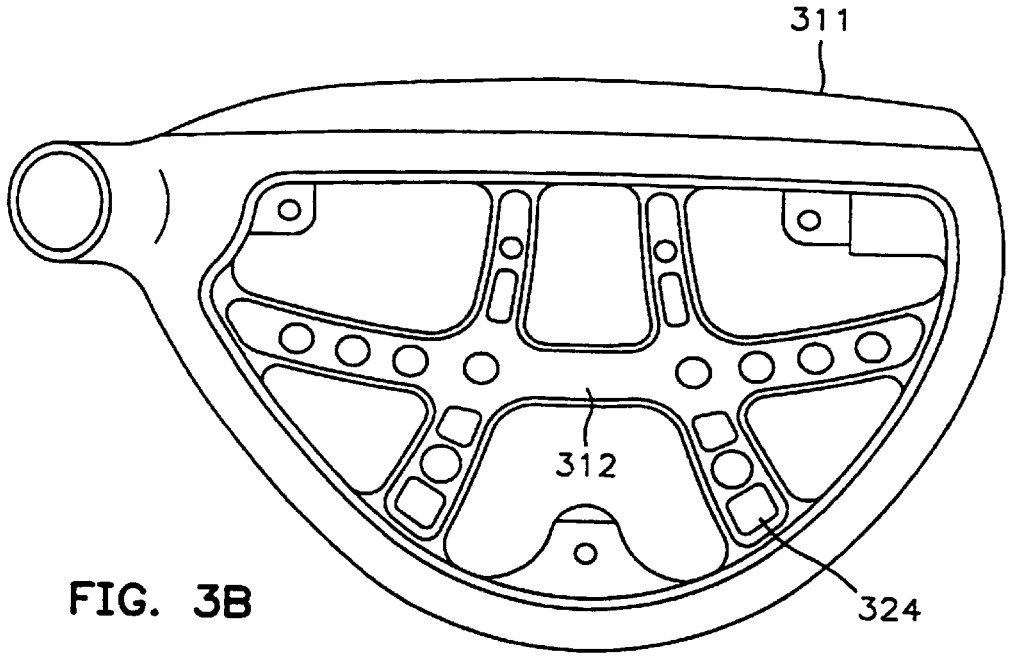
FIG. 3*b* is a top view of the golf club head of FIG. 3*a* with the top cover removed to show the inner structural detail.

Energy absorbing structure 312 of the embodiment shown in FIG. 3*a* is best illustrated in the top view of FIG. 3*b*. The structure is internal to the cavity formed by shell body 300 and extends between ball striking face 311 and at least one wall of the shell body. The structure absorbs forces encountered by ball striking face 311 and distributes the forces throughout the club head when a golf ball is struck. Ideally, weight relief openings 324 are formed in structure 312 to minimize weight and increase the discretionary weight available for head design. The weight reliefs may also be used to position discretionary weight inserts at desired locations within shell body 300 to "tune" the golf club's performance.

Figure 3C:
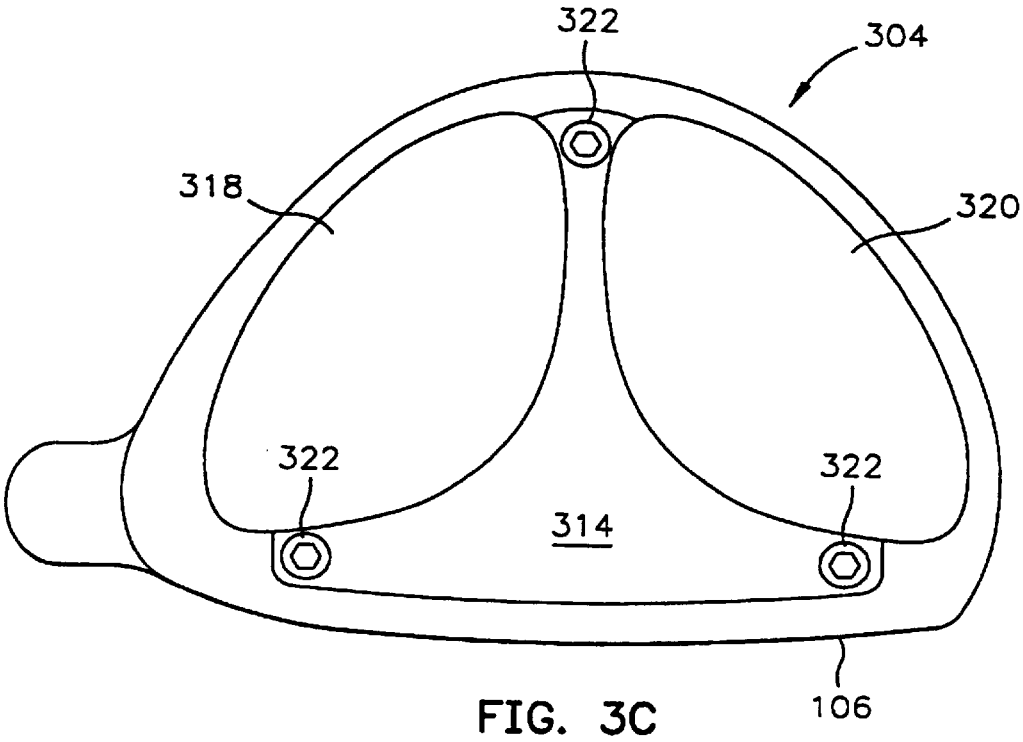
FIG. 3*c* is a bottom view of the golf club head of FIG. 3*a*.

The FIG. 3 alternate embodiment of the golf club head of the invention is also shown in bottom view FIG. 3*c*, which highlights the assembled positions of covers 318 and 320. Although only one heel cover and one toe cover are pictured, either one or multiple cover elements could be used and may be attached to bottom 304 or sole plate 314. Similarly, the sole plate could be manufactured integral to the cover or covers or integral to the internal energy absorbing structure.

The benefit of using the various structural configurations discussed above as the load-bearing structure of the club head is that the weight dedicated to forming the club head is greatly reduced, thereby resulting in an increase in the discretionary weight budget. Currently, prior art club head external bodies are the load bearing structure and require a substantial portion of the overall head weight to be designed into the load bearing body, thereby limiting the discretionary weight available to tune the club. Traditionally, they are manufactured as a two piece clam-shell design. The need to increase the discretionary weight available to further golf club head design has been satisfied by the present invention. Not only will it be possible with the present invention to lighten the weight of the body of a golf club head, it is also possible to increase the discretionary weight available to allow increased club performance by eliminating this design barrier inherent in current club head configurations.

Although the present invention has been described in considerable detail with reference to certain preferred versions thereof, other versions are possible as indicated. Therefore, the spirit and scope of the appended claims should not be limited to the description of the preferred versions contained herein.

What I claim is:

1. A golf club head having a discretionary weight budget, comprising:

an internal energy absorbing structure for providing the load bearing function for the golf club head;

a substantially non-load bearing thin-walled skin covering over the energy absorbing structure for defining a cavity and having a top, a bottom, a curved toe end, a curved heel end, a tail end and a ball striking face extending between said top and said bottom at an angle with respect to the vertical, wherein said ball striking face is generally flat, the energy absorbing structure being internal to said cavity and extending between said curved toe end, said curved heel end, said tail end, and said ball striking face, wherein said internal energy absorbing structure absorbs forces encountered by said skin ball striking face throughout said structure and allows the discretionary weight budget of said golf club head to be discretionary distributed wherein said energy absorbing structure includes:

an outer ring having a generally elliptical peripheral shape flattened on one side, wherein said flattened side intersects said ball striking face and is integral thereto;

at least one longitudinal frame element coupled to said ball striking face perimeter and extending from said ball striking perimeter to a point on said outer ring which is opposite from said ball striking face; and at least one latitudinal frame element having a frame element perimeter and a generally elliptical peripheral shape, said generally elliptical peripheral shape defining at least two sides and tow ends of said frame element perimeter, wherein ecah of said ends of said frame element perimeter is affixed to said outer ring at different locations, and wherein each of said sides attaches to at least one curved longitudinal frame element, and wherein said structure is an integral, unitary combination of said outer ring and said longitudinal and said latitudinal frame elements.

2. The golf club head recited in claim 1, wherein said energy absorbing structure includes at least one substantially horizontal structural member, wherein said member braces said ball striking face to prevent said face from permanently deforming when impacted by a golf ball.

3. The golf club head recited in claim 1, further comprising a hosel having a longitudinal axis extending generally upwardly from said heel end of said thin-walled skin.

4. The golf club head recited in claim 1, wherein said top of said thin-walled skin includes a top cover integral thereto.

5. The golf club head recited in claim 1, wherein said bottom further comprises a sole plate, wherein said sole plate is removably secured to said thin-walled skin.

6. The golf club head recited in claim 1, wherein said bottom further comprises at least one cover secured to said bottom.

7. The golf club head recited in claim 1, wherein said ball striking face is generally parallelogram shaped.

8. A golf club head having a discretionary weight budget, comprising:

a non-load bearing thin-walled skin defining a cavity and having a generally rounded top, a generally curved bottom, a curved toe end, a curved heel end, a tail end and a ball striking face extending between said generally rounded top and said generally curved bottom at an angle with respect to the vertical, wherein said ball striking face is generally flat;

a load-bearing energy absorbing structure internal to said cavity and extending between said curved toe end, said curved heel end, said tail end, and said ball striking face, wherein said energy absorbing structure absorbs forces encountered by said ball striking face throughout said structure and allows for discretionary distribution of said discretionary weight budget of said golf club head; and a hosel having a longitudinal axis extending generally upwardly from said heel end of said skin to secure said golf club head to a golf club shaft wherein said energy absorbing structure includes:

an outer ring having a generally elliptical peripheral shape flattened on one side, wherein said flattened side intersects said ball striking face and is integral thereto;

at least one longitudinal frame element coupled to said ball striking face perimeter and extending from said ball striking face perimeter to a point on said outer ring which is opposite from said ball striking face; and at least one latitudinal frame element having a frame element perimeter and a generally elliptical peripheral shape, said generally elliptical peripheral shape defining at least two sides and two ends of said frame element perimeter, wherein each of said ends of said frame element perimeter is affixed to said outer ring at different locations, and wherein each of said sides attaches to at least one curved longitudinal frame element, and wherein said structure is an integral, unitary combination of said outer ring and said longitudinal and said latitudinal frame elements.

9. The golf club head recited in claim 8, wherein said energy absorbing structure comprises at least one structural member, wherein said member braces said ball striking face to prevent said face from substantially deforming when impacted by golf ball.

10. The golf club head recited in claim 9, wherein said generally rounded top of said thin-walled skin includes a top cover integral thereto.

11. The golf club head recited in claim 8, wherein said bottom comprises a sole plate secured to said thin-walled skin.

12. The golf club head recited in claim 8, wherein said bottom further comprises at least one cover secured to said generally curved bottom. generally rounded top of said thin-walled skin includes a top cover integral thereto.

13. The golf club head recited in claim 8, wherein said ball striking face is generally parallelogram shaped.

14. A golf club head having a discretionary weight budget, comprising:

a load bearing energy absorbing means forming a cavity wherein said energy absorbing means comprises a frame element structure extending between a curved toe end, a curved heel end, a tail end, and a ball striking face, and wherein said energy absorbing means allows for discretionary distribution of said discretionary weight budget of said golf club head; and a thin-walled skin covering formed over the frame element structure, the thin-walled skin covering being substantially non-load bearing, the thin-walled skin covering defining a cavity and having a top, a bottom, a curved toe end, a curved heel end, a tail end and a ball striking face extending between said top and said bottom at an angle with respect to the vertical, and wherein said ball striking face is generally flat wherein said energy absorbing means includes:

an outer ring having a generally elliptical peripheral shape flattened on one side, wherein said flattened side intersects said ball striking face and is integral thereto;

at least one longitudinal frame element coupled to said ball striking face perimeter and extending from said ball striking face perimeter to a point on said outer ring which is opposite from said ball striking face; and at least one latitudinal frame element having a frame element perimeter and a generally elliptical peripheral shape, said generally elliptical peripheral shape defining at least two sides and two ends of said frame element perimeter, wherein each of said ends of said frame element perimeter is affixed to said outer ring at different locations, and wherein each of said sides attaches to at least one curved longitudinal frame element, and wherein said energy absorbing means is an integral, unitary combination of said outer ring and said longitudinal and said latitudinal frame elements.

15. The golf club head recited in claim 14, further comprising a hosel having a longitudinal axis extending generally upwardly from said heel end of said thin-walled skin covering.

16. The golf club head recited in claim 14, wherein said bottom includes a bottom plate intersecting said ball striking face.

17. The golf club head recited in claim 14, wherein said thin-walled skin covering is made of a semi-rigid material.

18. The golf club head recited in claim 14, wherein said thin-walled skin covering is made of a semi-rigid material.

19. The golf club head recited in claim 14, wherein said thin-walled skin covering includes a top cover integral thereto.

20. The golf club head recited in claim 14, wherein said bottom further comprises a sole plate secured to said thin-walled skin covering.

21. The golf club head recited in claim 14, wherein said bottom further comprises at least one cover secured to said thin-walled skin covering, wherein cover cooperates with said sole plate to form said bottom.

22. The golf club head recited in claim 14, wherein said ball striking face is generally parallelogram shaped.

* * * * *

UNITED STATES PATENT AND TRADEMARK OFFICE

CERTIFICATE OF CORRECTION

PATENT NO. : 5,997,415

DATED : December 7, 1999

INVENTOR(S) : Donald C. Wood

It is certified that error appears in the above-identified patent and that said Letters Patent is hereby corrected as shown below:

| COLUMN | LINE | |
|---|---|---|
| 6 | 6 | change "tow" to "two" |
| 6 | 7 | change "ecah" to "each" |
| 7 | 10 | change "9" to "8" |
| 7 | 18 | delete last sentence beginning with "generally" |

Signed and Sealed this

Twenty-sixth Day of September, 2000

*Attest:*

Q. TODD DICKINSON

*Attesting Officer*

*Director of Patents and Trademarks*